US007178683B2

(12) United States Patent
Birkmayer et al.

(10) Patent No.: US 7,178,683 B2
(45) Date of Patent: Feb. 20, 2007

(54) TWIST CLOSURE MEANS FOR A CONTAINER

(75) Inventors: Jörg Birkmayer, Vienna (AT); Ernest E. Kraxner, Graz (AT); Udo Suffa, Gefell/OT Rottmar (DE)

(73) Assignee: Prof. Birkmayer Gesundheitsprodukte GmbH, Vienna (AT)

( * ) Notice: Subject to any disclaimer, the term of this patent is extended or adjusted under 35 U.S.C. 154(b) by 320 days.

(21) Appl. No.: 10/347,021

(22) Filed: Jan. 17, 2003

(65) Prior Publication Data

US 2003/0132244 A1 Jul. 17, 2003

(30) Foreign Application Priority Data

Jan. 17, 2002 (DE) ..... 102 02 147

(51) Int. Cl.
*B65D 39/08* (2006.01)

(52) U.S. Cl. ..... 215/257; 206/222; 215/DIG. 8; 220/278; 220/521

(58) Field of Classification Search ..... 206/219, 206/222; 215/6, 227, 257, DIG. 8; 220/278, 220/521, 522; 222/83
See application file for complete search history.

(56) References Cited

U.S. PATENT DOCUMENTS

| | | | | |
|---|---|---|---|---|
| 3,347,410 | A * | 10/1967 | Schwartzman | 222/80 |
| 3,802,604 | A * | 4/1974 | Morane et al. | 222/83 |
| 3,840,136 | A | 10/1974 | Lanfranconi et al. | |
| 4,024,952 | A | 5/1977 | Leit | |
| 4,177,938 | A | 12/1979 | Brina | |
| 4,387,998 | A | 6/1983 | Szigeti | |
| 5,038,951 | A * | 8/1991 | Rizzardi | 215/256 |
| 5,292,025 | A * | 3/1994 | Dubreul | 220/278 |
| 5,927,549 | A * | 7/1999 | Wood | 222/83 |
| 5,984,141 | A | 11/1999 | Gibler | |
| 6,116,445 | A * | 9/2000 | Ikemori et al. | 215/301 |
| 6,228,323 | B1 | 5/2001 | Asgharian et al. | |
| 6,705,462 | B2 * | 3/2004 | Kasuya | 206/222 |
| 6,766,903 | B1 * | 7/2004 | Yehhsu | 206/222 |

FOREIGN PATENT DOCUMENTS

| | | |
|---|---|---|
| DE | 27 54 100 | 6/1978 |
| DE | 82 14 974.7 | 8/1982 |
| EP | 0 190 593 | 8/1986 |
| EP | 0 778 221 | 6/1997 |
| GB | 1 013 353 | 12/1965 |
| WO | WO 01 08996 | 2/2001 |

* cited by examiner

*Primary Examiner*—John A. Ricci
(74) *Attorney, Agent, or Firm*—Kenyon & Kenyon LLP

(57) ABSTRACT

A twist closure for a container has a screw cap, which includes an inner cylinder and a cutting edge extending from the inner cylinder, and a supply container rotatably arrangeable on the inner cylinder. The supply container includes a supply container bottom and a pocket extending from the supply container bottom for accommodation of the cutting edge.

17 Claims, 9 Drawing Sheets

30
32a
4
36
46
56
58
I
II
III
IV
50
52
60
62
64
42
44
48
38
54

TWIST CLOSURE MEANS FOR A CONTAINER

FIELD OF THE INVENTION

The present invention generally relates to a twist closure means for a container and, in particular, to a twist closure means having a screw cap and, arranged in the screw cap, a supply container having substances accommodated therein, which can enter the container via an opening created in the supply container when removing the twist closure means.

BACKGROUND OF THE INVENTION

For containers, such as bottles, cans, tubes and the like, it is often required to add additives to container contents just shortly before application. A manual adding of the additives requires efforts and can cause an undesired relation of additive and container content to be obtained.

For that purpose, it is known to use devices serving as container closure means, which comprise, in one or several chambers, additives to be mixed with container contents. Upon opening or closing of such a container closure means, the chamber(s) is (are) opened such that the additives contained therein can enter into the container interior.

From U.S. Pat. No. 4,024,952, a screw closure for a container is known, wherein, upon a rotational movement for opening the closure means, an insert comprising additive substances for mixing with the container content is rotated in relation to a lid. With it, due to friction of the insert on the inner side of the container opening, a predetermined breaking point of the insert is cut and a lid closing the insert is removed therefrom. Thereby, the additive substances can enter from the insert into the container, wherein it is disadvantageous that the closing lid cut from the insert also falls into the container interior.

EP 0 190 593 A2 discloses a closing cap for two-component packaging systems, in which a concentrate to be mixed with a bottle content is accommodated. In an embodiment, the closing cap comprises an inner cylinder with an outer thread, on which a pot-like container with an inner thread including the concentrate is screwed on. With it, the well running of a thread of the closing cap for screwing onto a bottle and the running well of the outer thread of the inner cylinder are selected such that, upon rotation of the closing cap, the container is screwed further onto the inner cylinder until the inner cylinder cuts a predetermined breaking point in the area of the bottom of the container. Via the thusly generated opening of the container, the concentrate accommodated therein can enter into the bottle. Here again, the bottom of the container is cut therefrom and, thus, enters into the bottle interior. In an embodiment of this closing cap, the opening of the container for release of the concentrate is effected upon rotation of the closing cap in closing direction. With it, an undesired release of the concentrate into the bottle can occur if the closing cap is rotated too far in closing direction.

From DE 82 14 974 U1, a closing cap for a container is known, wherein a medium to be charged into the container is contained. By rotating the closing cap, a channel in the closing cap is released, through which the medium can enter into the container. For releasing the channel, window areas of two cylinders arranged within another are to be overlapped. Here, it is disadvantageous that the closing cap must be rotated exactly such that the window areas assume the positions necessary for clearing the channel.

U.S. Pat. No. 5,984,141 discloses a screw closure for a drinking container. In the screw closure, a fluid to be mixed with a container fluid is accommodated, which can be charged into the container by rotation of the screw closure. Upon rotation of the screw closure, a channel is released, through which the fluid from the screw closure can enter into the container. Here again, the screw closure is to be rotated exactly such that the channel is released. Further, by the extent of the rotation of the closing cap, the amount of fluid of the screw closure which shall enter into the container is determined. This can cause the amount of fluid of the screw closure which enters into the container to be too small.

SUMMARY OF THE INVENTION

The object of the present invention is to provide a closure means for a container, which enables substances being located in the closure means to enter into the container interior upon opening the container, wherein the drawbacks of the state of the art are avoided. That is, it should be guaranteed that, except for the substances contained in the closure means, no components of the closure means can enter into the container interior. Further, the closure means should be easily and reasonably able to be manufactured and assembled.

The approach underlying the present invention is that the twist closure means according to the invention comprises, extending in the interior of a screw cap, a cutting edge, which is accommodated in a pocket of a supply container when being arranged on the screw cap.

In an embodiment of the invention, a twist closure means for a container, such as a bottle, for example, is provided. The twist closure means according to the invention comprises a screw cap having an inner cylinder and a cutting edge extending from the inner cylinder. Further, a supply container for rotatable arrangement on the inner cylinder is provided, which comprises a supply container bottom and a pocket extending therefrom for accommodation of the cutting edge.

Preferably, the pocket does not only define a rectangular parallelepiped space being opened in an upward direction for accommodation of the cutting edge, but also defines a space, the "bottom" of which extends obliquely running with respect to the supply container bottom. Thus, the pocket can comprise an even lower face, which represents the bottom of the rectangular parallelepiped accommodation space, and, extending from the lower face to the supply container bottom, a curved face, which forms the obliquely running bottom.

In another embodiment of the invention, in order to ease the opening of the supply container, a transition from the curved face to an outer surface of the pocket can comprise a material taper. This transition makes it easier to create, by means of the cutting edge, an opening in the supply container.

Preferably, the transition between the supply container bottom and the supply container wall is helically shaped and comprises a pitch, which essentially corresponds with a pitch of a thread pairing provided for the arrangement of the screw cap on a container.

In yet another embodiment of the invention, in order to facilitate the cutting process, upon further opening the supply container, a transition between the supply container bottom and a supply container wall comprising a material taper can be included. Here, the whole transition area between the supply container bottom and the supply container wall can be shaped as such. As an alternative, it is possible to shape, subsequent to the transition from the curved face to the outer face of the pocket, a portion of the transition area between the supply container bottom and the supply container wall to a thinner degree. Thereby, the cutting process can be limited.

Preferably, the supply container wall is cylindrical and surrounds, at least partially, the inner cylinder, when the supply container is arranged on the screw cap.

In order to prevent rotations of the supply container together with the screw cap upon rotation of the twist closure means in the opening direction, in one embodiment of the invention the supply container is provided with a structure acting as a rotation interlock upon rotations of the screw cap in the opening direction. For example, this can be achieved by means on a collar formed on the supply container having a saw-tooth-like structure formed thereon.

Preferably, the collar is arranged on the outer side of the supply container, wherein its saw-tooth-like structure points toward the supply container bottom. Alternatively, the saw-tooth-like structure of the supply container can also point outward in the radial direction. The orientation of the saw-tooth-like structure depends upon how the opening area of the bottle is shaped.

Preferably, the effect of the saw-tooth-like structure of the supply container as a rotation interlock is provided only for a predetermined rotation, for example for 180°, of the twist closure means in the opening direction.

In a further embodiment of the invention, a step can be arranged on the inner cylinder, which extends on the outer peripheral surface and in the peripheral direction of the inner cylinder.

For interaction with this step of the inner cylinder, upper and lower stops can be arranged on the supply container. Together with the step of the inner cylinder, the upper and lower stops of the supply container limit movements of the supply container in relation to the screw cap in the longitudinal direction of the inner cylinder when the supply container is arranged on the inner cylinder.

In a still further embodiment of the invention, it is possible that, adjacent to the end of the inner cylinder opposite the cutting edge, a step, for example a bar circularly surrounding the inner cylinder, is formed on the inner side of the screw cap. This step serves to limit movements of the supply container along the inner cylinder.

In still another embodiment of the invention, the step of the inner cylinder and/or the upper and lower steps of the supply container can be shaped for the sealing of substances located in the supply container.

For arranging the twist closure means on a container, one embodiment of the invention provides for a screw cap wall, preferably formed as an outer cylinder surrounding the inner cylinder, which is equipped with a thread.

Another embodiment of the invention includes an originality ring being connected with the screw cap wall via a predetermined breaking point. The originality ring is present in order to check whether the twist closure means of the invention, being arranged on a container, has been previously opened at least once.

Still another embodiment of the invention provides a container for use with the twist closure means according to the invention, wherein the container comprises a saw-tooth-like structure on its opening, which is designed for interaction with the saw-tooth-like structure of the supply container. Preferably, the saw-tooth-like structure of the container is designed such that it allows, in interacting with the saw-tooth-like structure of the supply container, rotations of the same only in the closing direction.

DETAILED DESCRIPTION

Figure 2:
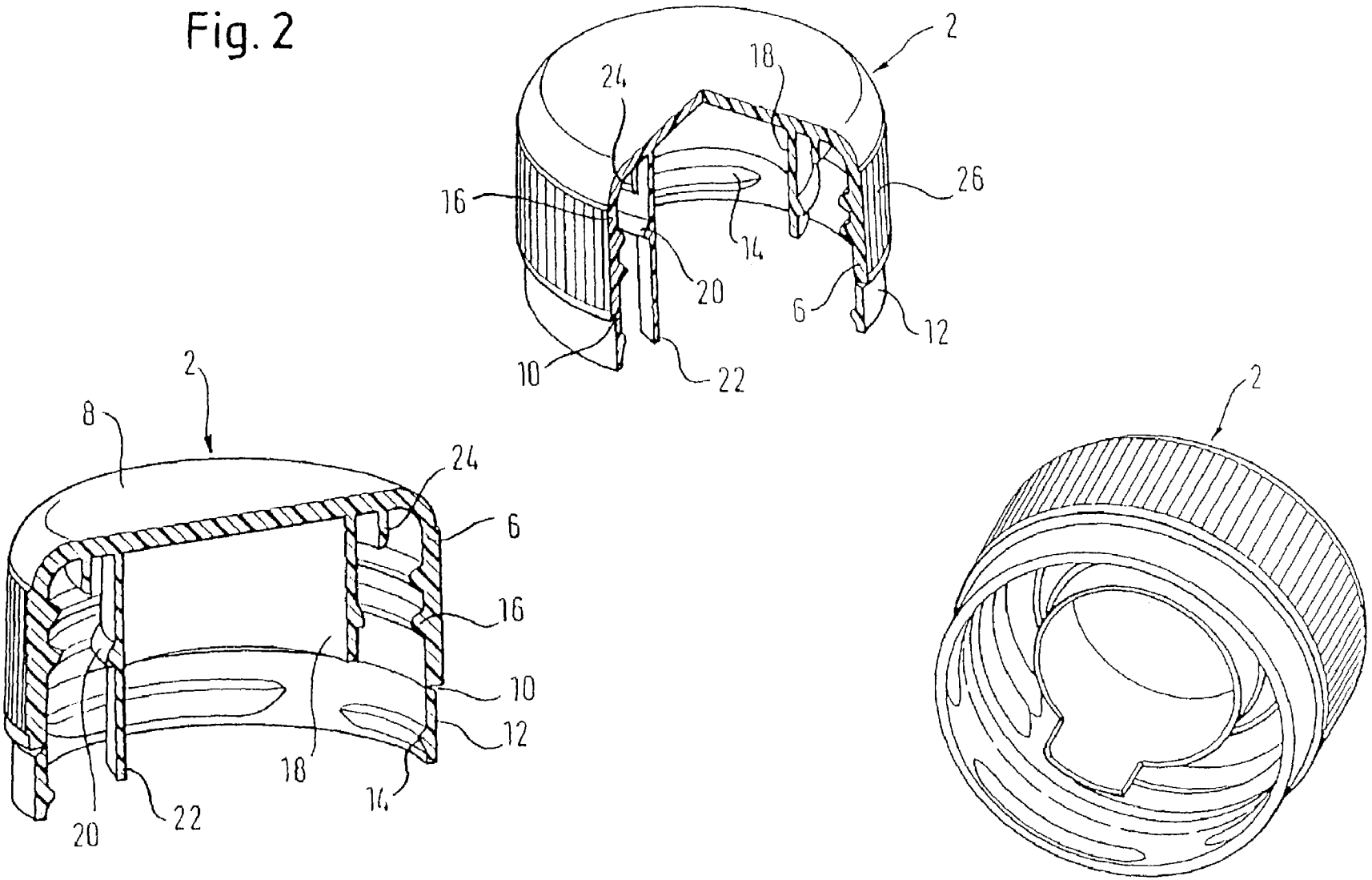
FIG. 2 shows schematic illustrations of a screw cap of the twist closure means according to a preferred embodiment of the invention.
Figure 3:
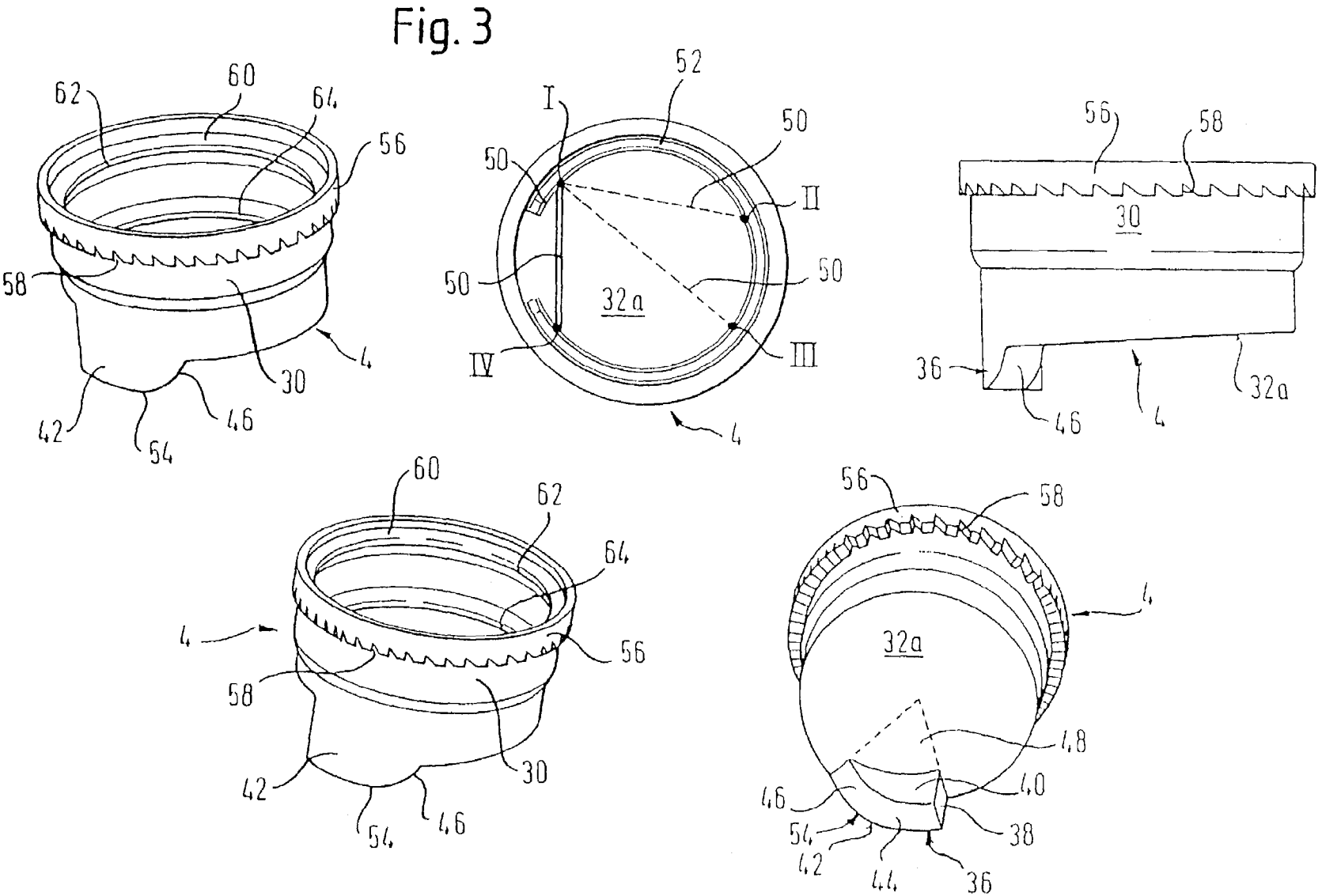
FIG. 3 shows schematic illustrations of a supply container of the twist closure means according to a preferred embodiment of the invention.
Figure 4:
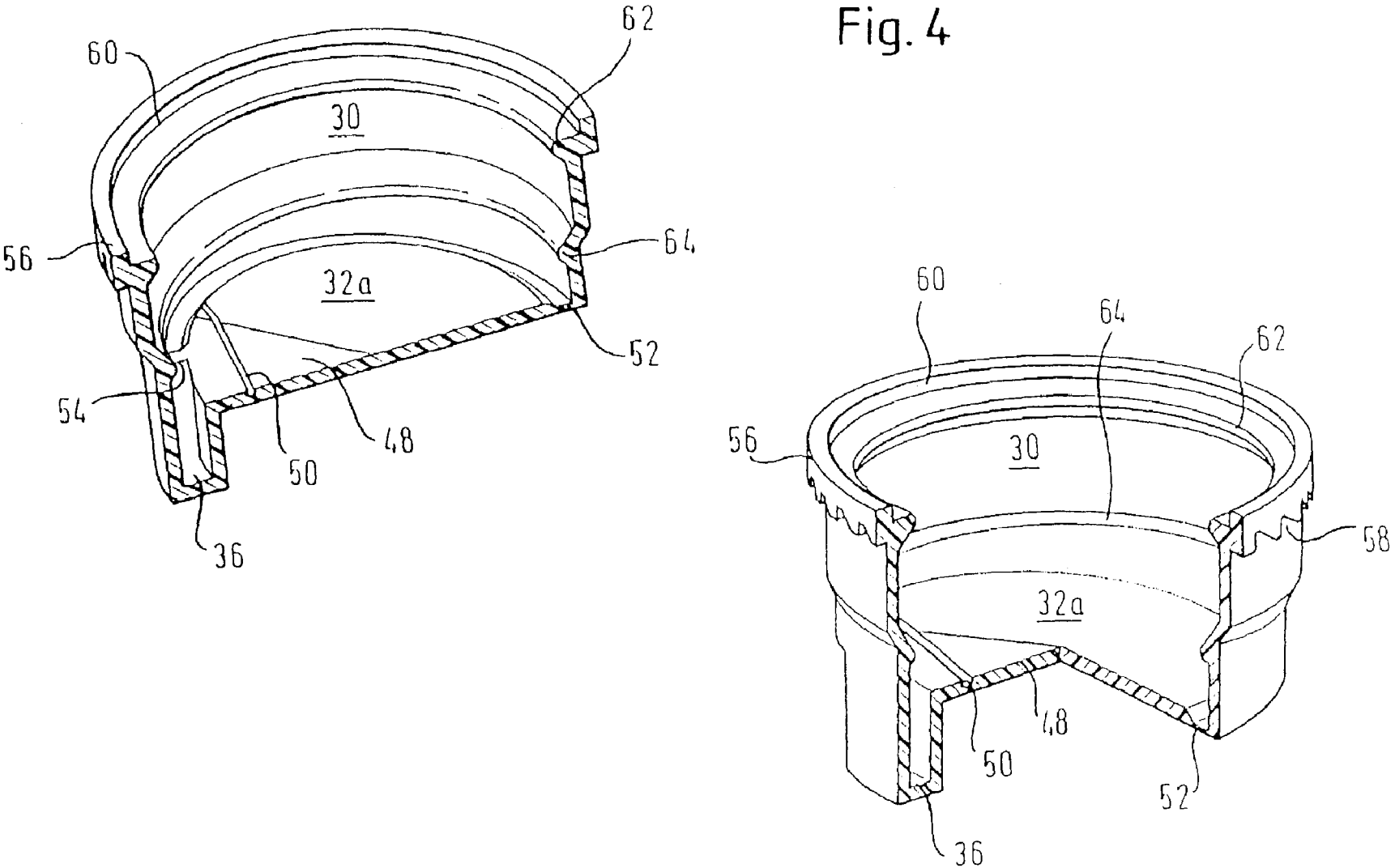
FIG. 4 shows schematic illustrations of a supply container of the twist closure means according to a preferred embodiment of the invention.
Figure 5:
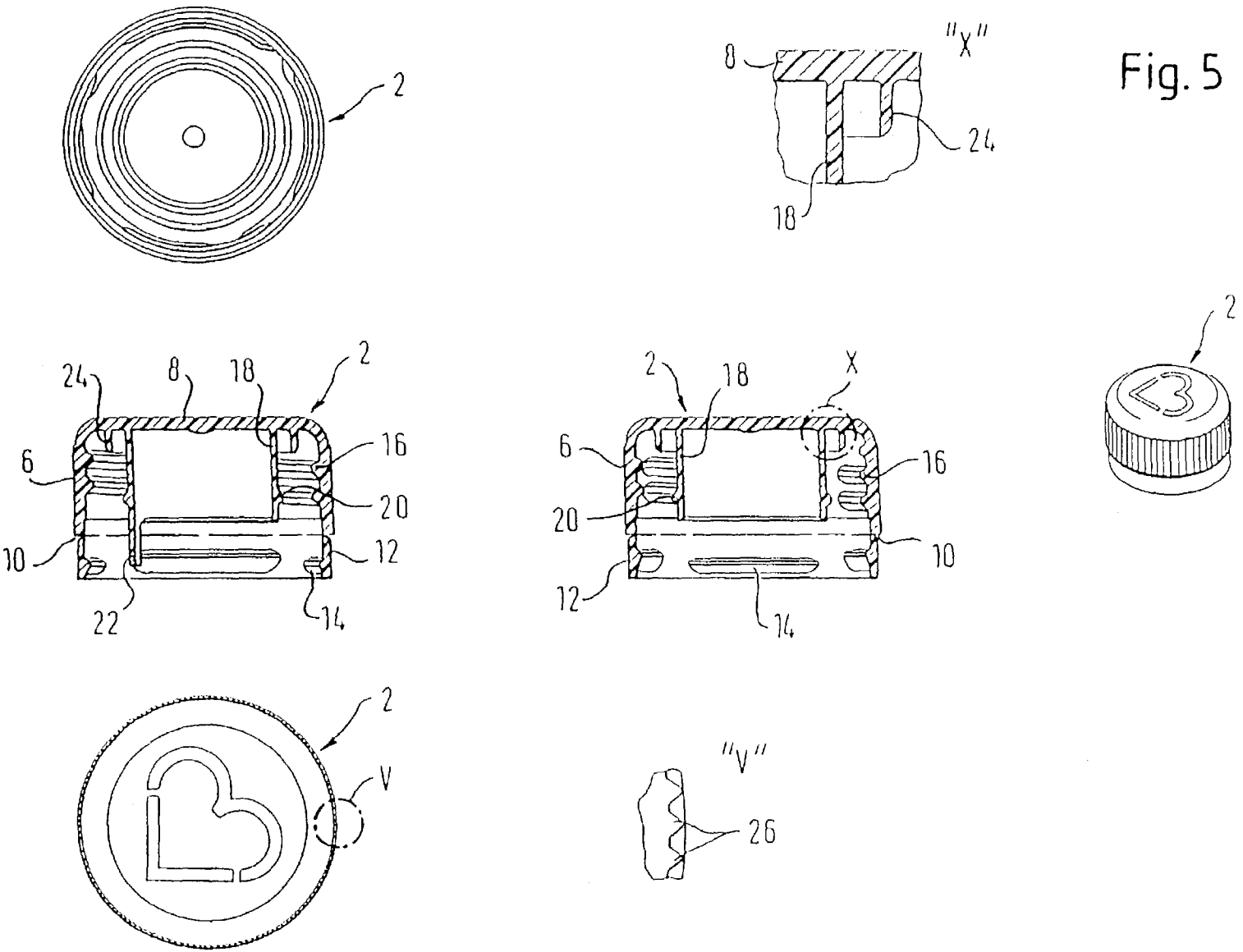
FIG. 5 shows further schematic illustrations of the screw cap of FIGS. 1 and 2, and the supply container of FIGS. 3 and 4.
Figure 6:
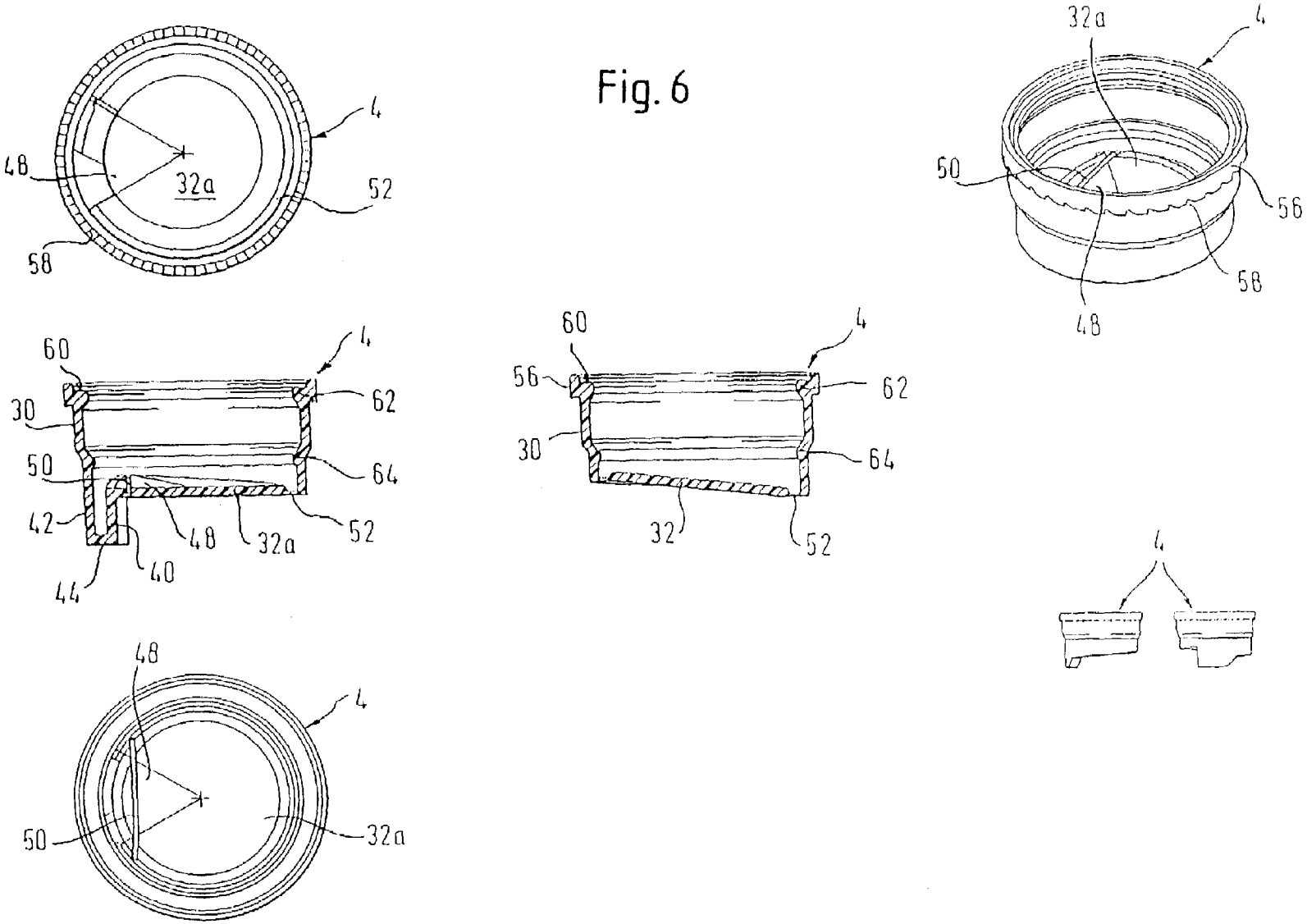
FIG. 6 shows further schematic illustrations of the screw cap of FIGS. 1 and 2, and the supply container of FIGS. 3 and 4.

Referring to the enclosed figures, an embodiment of the invention of a twist closure means for a container is described, which comprises a screw cap 2 (see FIGS. 1, 2 and 5) and a supply container 4 (see FIGS. 3, 4 and 6). In the supply container 4, substances can be accommodated, which shall enter, upon opening the twist closure means, into the interior of a container which is closed with the same.

Figure 1:
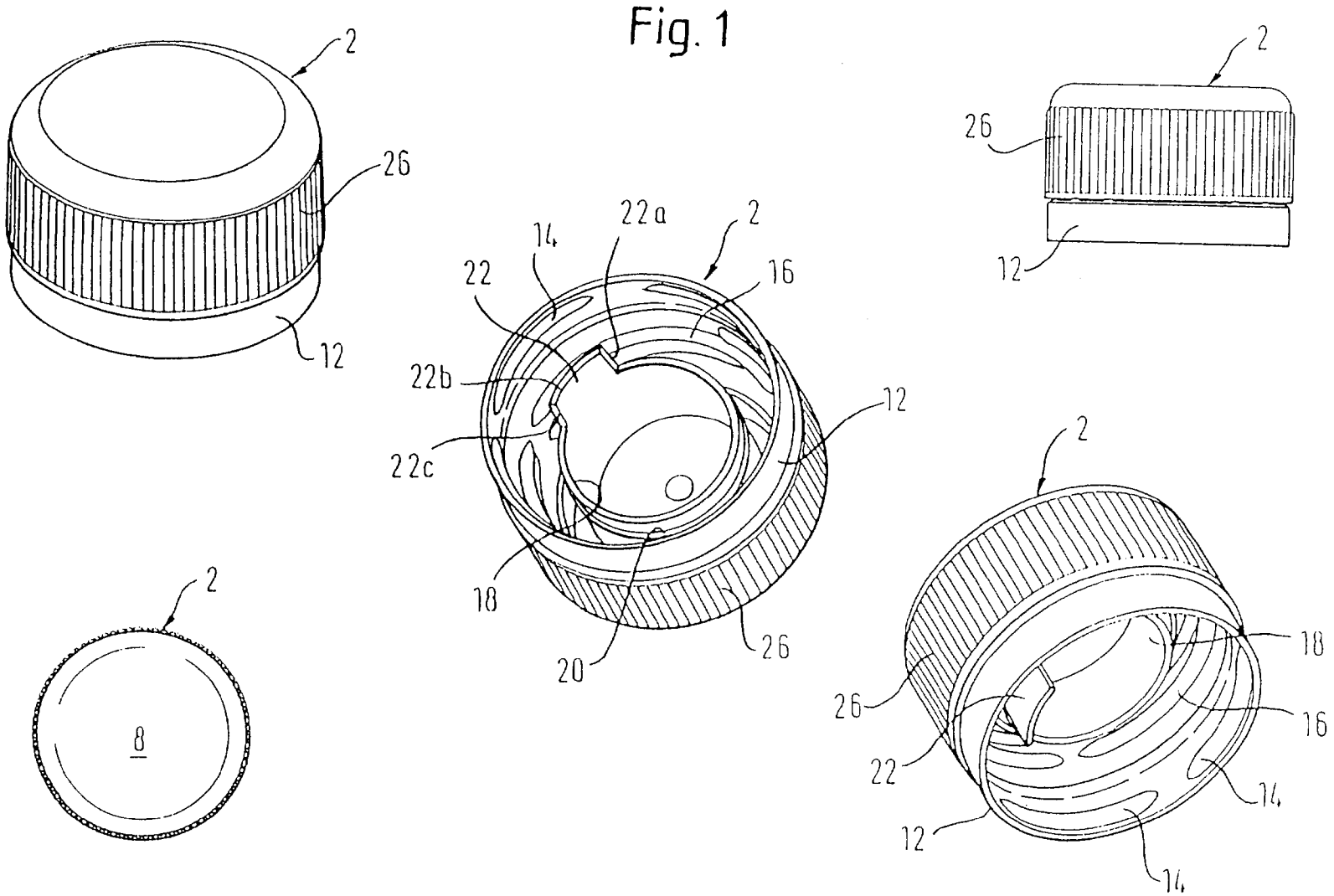
FIG. 1 shows schematic illustrations of a screw cap of the twist closure means according to a preferred embodiment of the invention.

As illustrated in FIGS. 1, 2 and 5, the screw cap 2 comprises a screw cap wall 6 having an essentially circularly shaped cross section and a screw cap ceiling 8 being connected with the screw cap wall 6. The face (not referenced) opposing the screw cap ceiling 8 of the screw cap wall 6 is connected with an originality ring 12 via a connection formed as a predetermined breaking point. As the screw cap 2 is unscrewed from a container sealed with the same, single or several structures 14 formed on the originality ring 12 interact with corresponding structures formed on the container such that the connection of the originality ring 12 with the screw cap wall 6 is torn, i.e., the predetermined breaking point is undone. In this way, it is indicated that the screw cap 2 has been at least once removed from a container closed thereby, while an originality ring 12 being connected with the screw cap wall 6 indicates that the screw cap 2 was not removed from the container yet.

Figure 7:
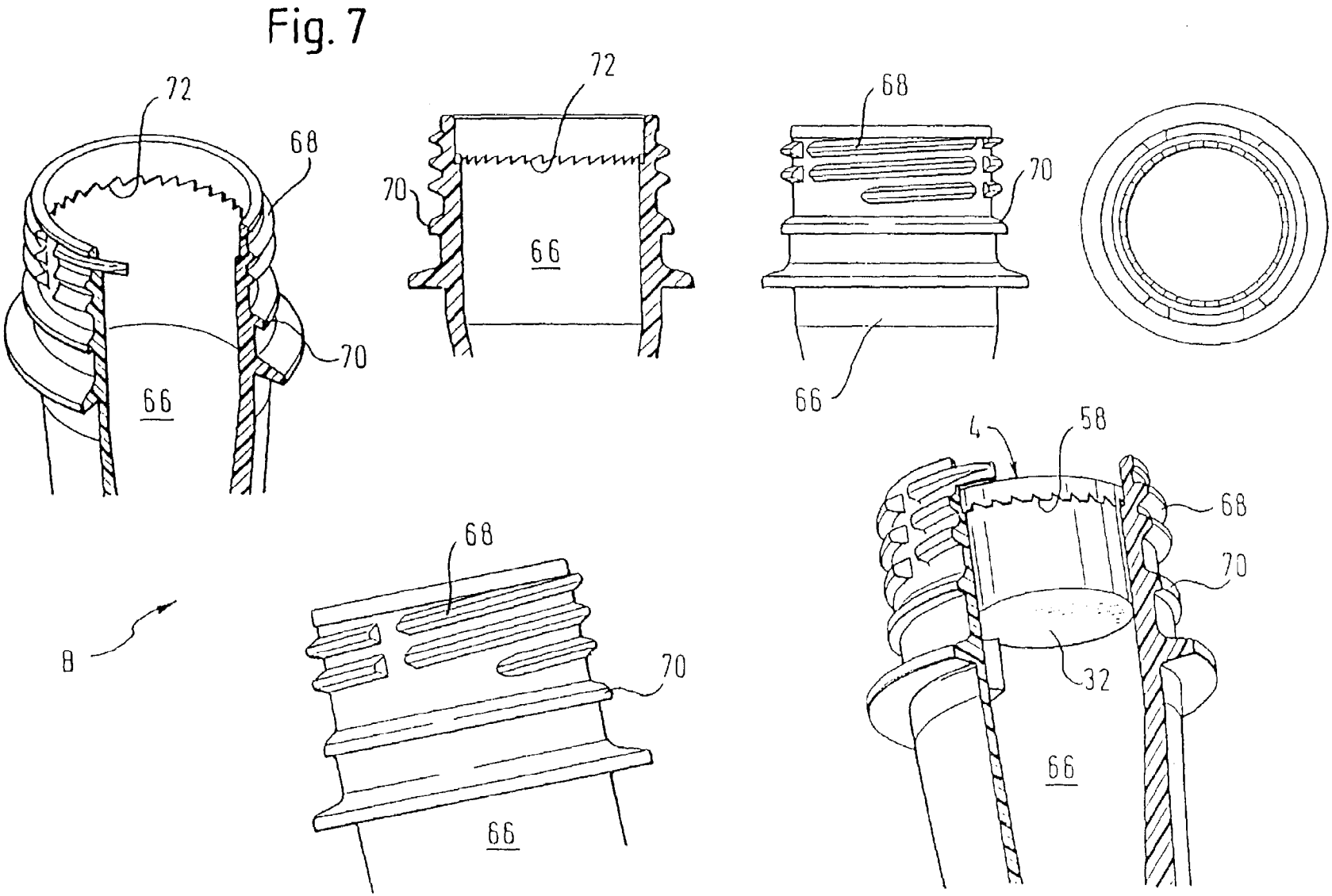
FIG. 7 shows schematic illustrations of an opening area of the container according to a preferred embodiment of the invention.
Figure 8:
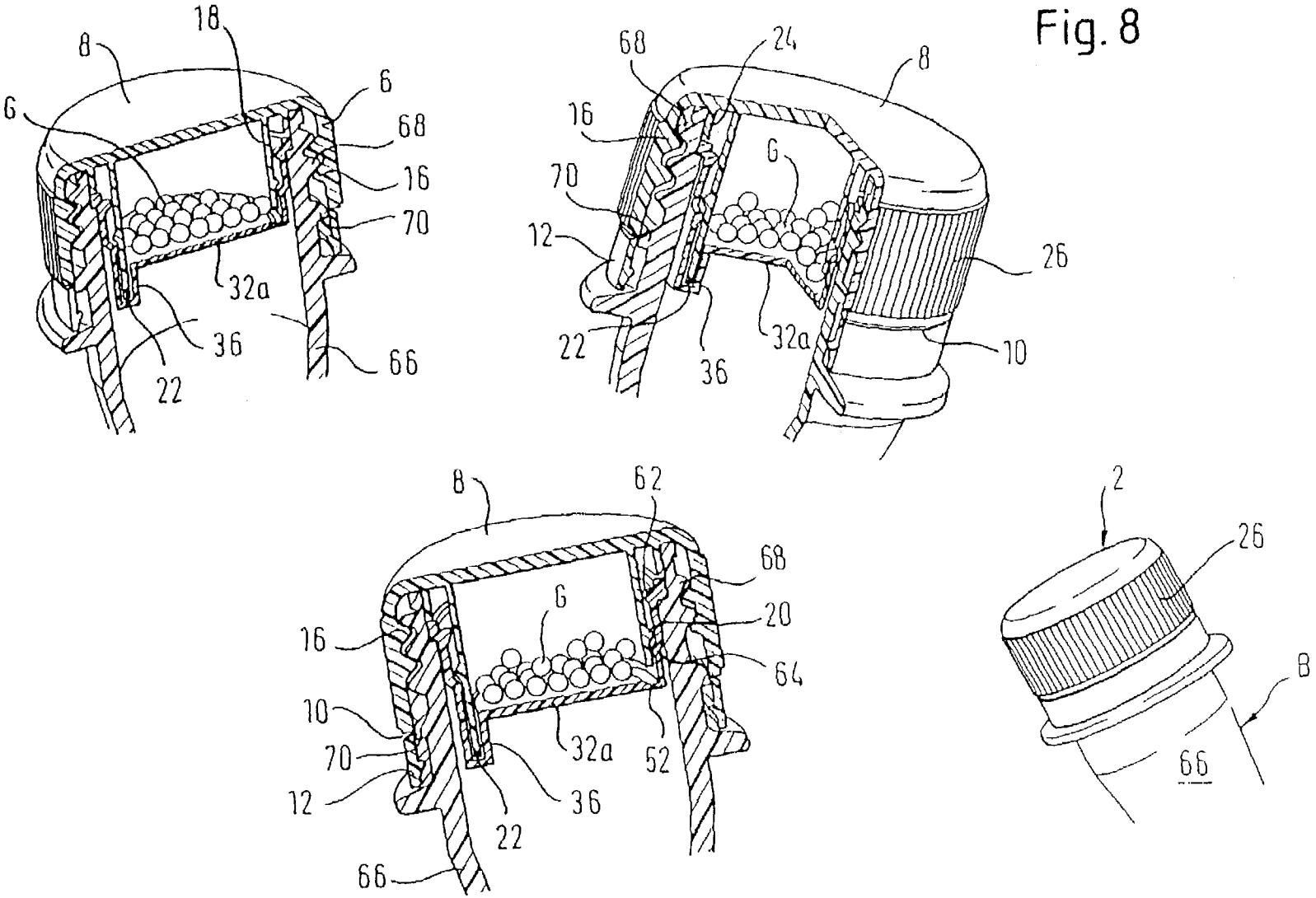
FIG. 8 shows schematic illustrations of the screw cap of FIGS. 1, 2 and 5, and the supply container of FIGS. 3, 4 and 6, in conditions being arranged on the container opening of FIG. 7.
Figure 9:
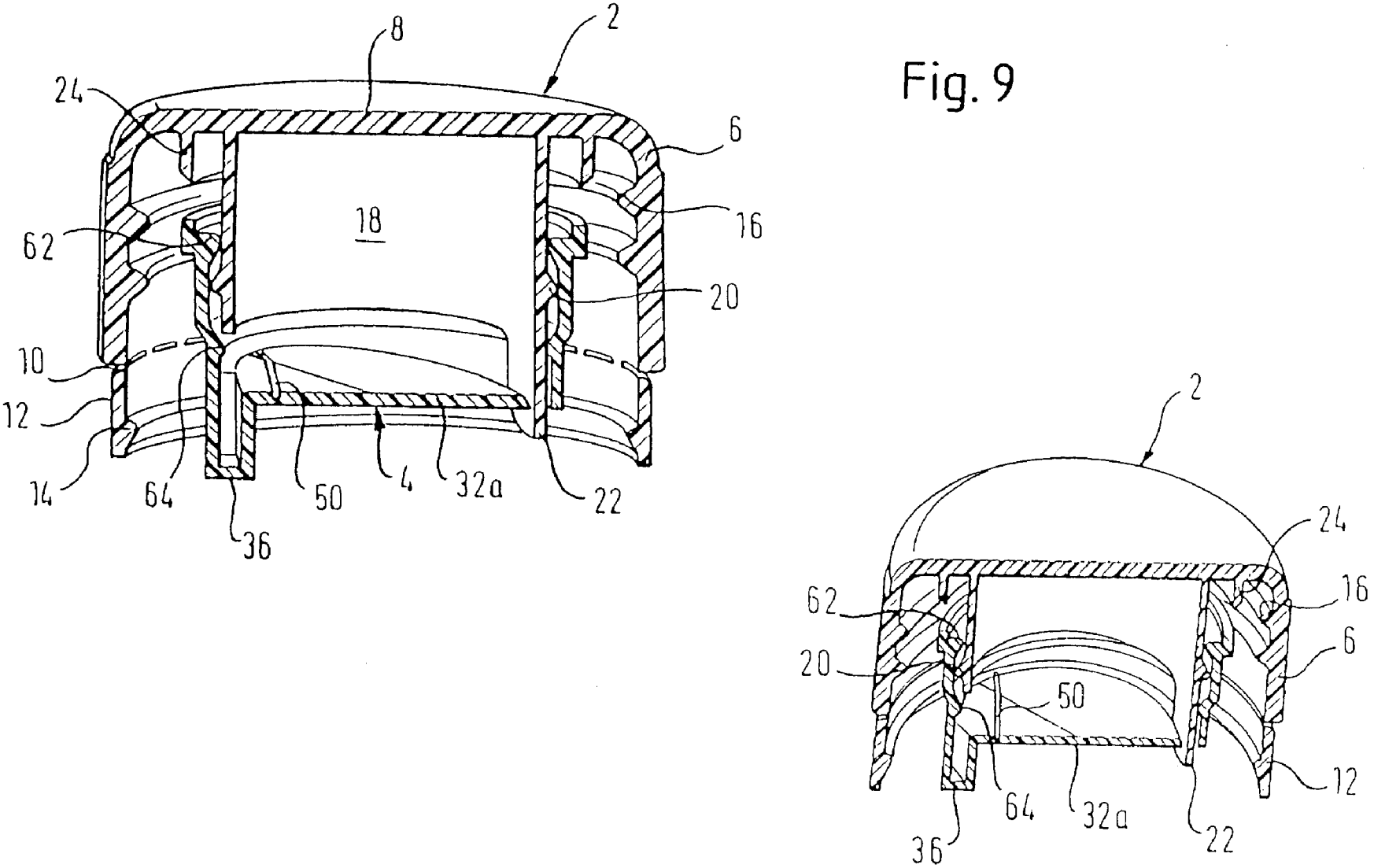
FIG. 9 shows schematic illustrations of the screw cap of FIGS. 1, 2 and 5, and the supply container of FIGS. 3, 4 and 6, in a position for rotation in the opening direction.

The screw cap wall 6 comprises a thread 16 on its inner side in order to screw the screw cap 2 onto a correspondingly shaped outer thread of a container (see FIGS. 7–9). Further, a tubular structure, referred to as inner cylinder 18 in the following, is extending from the screw cap ceiling 8. The inner cylinder 18 comprises an essentially circularly shaped cross section and is essentially coaxially orientated with respect to the screw cap wall 6. On the outer side of the inner cylinder 18, a step 20 is arranged, which lies in a plane being essentially parallel to the screw cap ceiling 8 and which extends around the inner cylinder 18 in ring-form.

On its free end opposite the cap ceiling 8, the inner cylinder 18 comprises a cutting edge 22 tongue-likely extending in its longitudinal direction. The cutting edge 22 forms a surface area of an imaginary extension of a portion of the free end of the inner cylinder 18. Accordingly, the cutting edge 22 has the same radius of curvature as the inner cylinder 18. In the illustrated embodiment, the radial dimensions of the inner cylinder 18 and the cutting edge 22 also correspond to each other, i.e., both have approximately the same thickness. Further, the faces of the free end of the cutting edge 22 can be formed slanted or sharp-edged to support the opening of the supply container 4. For example, in one embodiment the lateral face 22*a* and/or the face 22*b*, at least in its portion adjacent the face 22*a*, are formed sharp-edged. The other lateral face 22*c* can be formed blunt in order to avoid undesired damages of the supply container 4.

Further, on the inner side of the screw cap ceiling 8, a circularly formed bar 24 acting in the longitudinal direction of the inner cylinder 18 is arranged, which is essentially concentrically arranged with respect to the screw cap wall 6 and the inner cylinder 18, respectively, and which circularly surrounds the latter. Preferably, the outer side of the screw wall 6 is, at least partially, provided with a structured surface 26 in order to support the manipulation of the screw cap 2 upon arrangement on and removal from a container.

The supply container 4 illustrated in FIGS. 3, 4 and 6 comprises a supply container wall 30 having an essentially circularly formed cross section and a supply container bottom 32 being connected with the same.

The supply container bottom 32 comprises a supply container bottom portion 32*a* and a pocket-like extension or pocket 36, which serves for accommodation of the cutting edge 22 if the supply container 4 is arranged on the inner cylinder 18.

The pocket 36 is limited by surfaces 38 to 46. The surface 38 extends in the longitudinal direction and in the radial direction of the supply container 4. Seen in the radial direction of the supply container 4, the inner and outer boundary surfaces 40 and 42 are curved surfaces with essentially the same radius of curvature, which approximately corresponds with the radius of curvature of the supply container wall 30. The face 44 lies in a plane perpendicular to the longitudinal direction of the supply container 4, while the face 46 is, if applicable, a curved surface extending from the face 44 towards the supply container bottom portion 32*a*. The face 46 forms a surface tilted in relation to the longitudinal direction of the supply container 4. The surfaces 38, 40, 42 and 44 define a space for accommodation of the cutting edge 22, which is accommodated therein if the supply container 4 is maximally pushed onto the inner cylinder 18.

The supply container bottom 32 comprises a surface area 48 obliquely extending in relation to the longitudinal axis of the supply container 4. The obliquely extending surface area 48, the boundaries of which being illustrated by means of dotted lines in FIG. 3, extends, starting from the surface 40 of the pocket 36 towards the center of the supply container bottom 32, in a tapered manner.

Further, the supply container bottom 32 comprises a material taper 50 diagonally extending through the same. As illustrated by dotted lines, which are indicated with the reference numeral 50 in the upper middle illustration of FIG. 3, different arrangements of the material taper 50 are possible, the effect of which being described below.

A transition 52 between the supply container bottom 32 and the supply container wall 30 is tapered in relation to the thickness of the supply container wall 30 and/or the thickness of the supply container bottom 32, i.e., has a smaller thickness. The transition 52 is provided as a predetermined breaking point or predetermined detaching point in order to support the interaction with the inner cylinder 18 as described in the following. Such a material taper is also provided on a transition 54 between the surfaces 44 and/or 46 and the surface 42 of the pocket 36.

The transition 52 is helically extending in relation to the longitudinal direction of the supply container 4 and the screw cap 2, respectively, wherein the pitch of the helical lines formed by the transition 52 essentially corresponds with the pitch of a thread pairing, which is formed by the thread 16 of the screw cap 2 and a thread being arranged in an opening portion of a container to be used with the twist closure means. This design of the transition 52 can be obtained by, as illustrated in FIG. 6, the supply container bottom portion 32*a* forming a slanted, obliquely extending surface in relation to the longitudinal direction of the supply container 4. The helical shape of the transition 52 can also be obtained in that the supply container bottom portion 32*a* is sufficiently thick such that the transition 52 can be helically formed therein. This helically shaped design of at least the transition 52 allows a more compact structural shape, in particular a smaller extension of the cutting edge 22 in the longitudinal direction, since the position of the cutting edge 22 and the portion of the cutting edge 22 separating the transition 52, respectively, is maintained in relation to the transition 52 upon unscrewing the screw cap 2 due to the helical design.

On the end of the supply container 4 opposite to the supply container bottom 32, an outer collar 56 is arranged, which comprises a saw-tooth-like structure 58 on its face oriented towards the supply container bottom 32 and which is adapted for arrangement of sealing elements (not illustrated) on its opposite face. For accommodation of sealing elements (e.g., sealing rings) in this embodiment, a step 60 being provided by the collar 56, optionally in cooperation with the supply container wall 30, is provided.

On its inner side, the supply container 4 further comprises an upper stop 62 being formed in a ring-shape and a lower step 64 being formed in a ring-shape. As can be seen in the figures, the lower stop 64 can be obtained, for example, by a reduction of the cross-section of the supply container wall 30, at least in the area contemplated for the lower stop 64. The distance between the upper and lower stops 62 and 64 in the longitudinal direction of the supply container 4 defines a clearance for movements of the supply container 4 relative to the screw cap 2.

For use of the closure means, a substance G, which shall be charged upon actuation of the closure means into a container used with the same, is arranged in a space (not indicated) being confined by the supply container wall 30 and the supply container bottom 32. Examples for such a substance comprise medical and non-medical globuli, pills, powders, fluids, etc. and combinations of the same. After charging, the supply container 4 is pushed over the inner cylinder 18 of the screw cap 2 until the upper stop 62 of the supply container 4 reaches behind the step 20 of the screw cap 2. In this manner, the supply container 4 is secured on the screw cap 2. Movements of the supply container 4 relative to the screw cap 2, in particular movements in the longitudinal direction of the inner cylinder 18, are limited by means of the upper and lower stops 62 and 64 of the supply container 4 in engagement with the step 20 and in dependence on the clearance defined by the distance of the upper and lower stops 62 and 64 in the longitudinal direction of the supply container 4.

In a preferred embodiment, the clearance defined by the upper and lower stops 62 and 64 for movements of the supply container 4 in relation to the inner cylinder 18 should be dimensioned such that the supply container 4 can be rotated around the inner cylinder 18, with the cutting edge 22 not extending into the pocket 36. In this manner, it is not required, upon (at least initially) arranging the supply container 4 on the inner cylinder 18, to align the same in relation to each other such that the cutting edge 22 and the pocket 36 are aligned in relation to each other. Rather, the supply container 4, as being arranged on the inner cylinder 18, can be initially oriented in relation to the same in any way since an alignment of the cutting edge 22 and the pocket 36 relative to each other is obtained by means of subsequently rotating the screw cap 2 and the supply container 4.

The bar 24 serves as a stop for limiting movements of the supply container 4 in the direction towards the screw cap ceiling 8 such that the supply container 4 cannot be pushed onto the inner cylinder 18 so far that the step 20 reaches behind the lower stop 64. In this manner, it is avoided that the supply container bottom 32 and, in particular, the pocket 36 is damaged by the cutting edge 22, if, for example, when manipulating the screw cap 2 with the supply container 4 being arranged thereon, a force is applied thereon in the direction towards the screw cap ceiling 8.

Further, the bar 24 serves as a sealing cone or sealing cylinder, which interacts with the collar 56, the step 60 and sealing elements arranged thereon, respectively, in order to close the supply container 4 in a sealing manner, in particular with respect to a container being used with the twist closure means.

In order to close the inner space confined by the inner cylinder 18 and the supply container 4 in a sealing manner, in particular in case of fluids or substances of small particle size existing therein, on the step 62 of the supply container 4, for example, a sealing ring (not illustrated), which engages in a sealing manner the outer side of the inner cylinder 18, can be used. Furthermore, the step 20, optionally having a sealing element (e.g., sealing ring) being arranged on the step 20, can be shaped such that a sealing between the inner cylinder 18 and the portions of the inner surface of the supply container 4 being located between the upper and lower steps 62 and 64 is obtained. Also, a coating being suitable for sealing of the inner side of the supply container 4 between the upper and lower steps 62 and 64 is possible.

The details given below regarding the screw cap 2 and the supply container 4 are illustrative examples only (see also, FIGS. 5 and 6), and the present invention is not to be limited thereto.

| Screw cap 2 | |
|---|---|
| Material: | PT |
| Weight: | ca. 3.2 g |
| Outer diameter: | 30.3 mm |
| Height: | 19.8 mm |
| Thread: | pitch of eight rotations per 3.175 mm; ca. two rotations |
| **Supply container 4** | |
| Material: | PT |
| Weight: | ca. 0.8 g |
| Outer diameter: | 22.2 mm |
| Height: | 14.6 mm |

For use with a closure means of the invention comprising the screw cap 2 and the supply container 4, an opening of a container B, for example a bottle (not illustrated), is used, which, as illustrated in FIG. 7, comprises an opening wall 66. The opening wall 66 comprises, on its outer side, a thread 68 being adapted for engagement with the thread 16 of the screw cap 2 and a step 70 being adapted for engagement with the originality ring 12 and the structures 14 formed thereon, respectively. Further, on the inner side of the opening wall 66, a saw-tooth-like structure 72 exists, which is complementarily formed with respect to the saw-tooth-like structure 58 of the supply container 4.

In a particular embodiment, the saw-tooth-like structures 58 and 72 are formed such that they, if being brought or being in engagement with each other, allow rotations of the supply container 4 in the closing direction, but prevent rotations of the supply container 4 in the opening direction.

For closing the opening limited by the opening wall 66 and, thus, a container B being connected therewith, the screw cap 2 being provided with the supply container 4 being arranged on its inner cylinder 18 is screwed by means of its thread onto the thread 68.

Upon screwing the screw cap 2 onto the thread 68, the positioning of the supply container 4 in relation to the screw cap 2 is maintained by means of the cutting edge 22 being accommodated in the pocket 36, which engages the face 22*b* on the inner side of the surface 38. This is even the case if the saw-tooth-like structure 58 of the supply container 4 engages the saw-tooth-like structure 72 of the container opening since its saw-tooth-like shapes are formed such that they allow movements of the saw-tooth-like structures 58 and 72 in relation to each other upon screwing on the screw cap 2.

After screwing on the screw cap 2, as shown in FIG. 8, the container B is closed and can be manipulated such that substance G being contained in the inner space being limited by the inner cylinder 18 and the supply container 4 cannot enter into the container B. This is accomplished by unscrewing the screw cap 2.

When unscrewing the screw cap 2 for the first time, the originality ring 12 is separated from the screw cap wall 6 by means of the step 70. Further, the supply container 4 is interlocked for rotation due to the engagement of the saw-tooth-like structures 58 and 72, i.e., its position in relation to the saw-tooth-like structure 72 after screwing on is maintained. Accordingly, a movement of the inner cylinder 18 relative to the supply container 4 occurs.

With the movement, the cutting edge 22, at least with the face 22*a*, dependent upon the embodiment of the cutting edge 22 and/or the pocket 36 also with the face 22*b*, comes into contact with the inner side of the pocket 36 in the area of the surface 46 and applies forces such that the transition 54 is separated, pushed through, cut or the like.

Upon further rotation of the screw cap 2 in the opening direction, the face 22*a* of the cutting edge 22 separates the supply container bottom 32 in the area of the transition 52. This procedure continues until the step 20 of the inner cylinder 18 contacts the upper stop 62 of the supply container 4.

Because of the separation of the transition 54 and the partial separation of the transition 52, the supply container bottom 32 folds downwards (i.e., in the direction away from the screw cap ceiling 8). Via the thusly created opening, the substances contained in the space limited by the inner cylinder 18 and the supply container 4 can enter into the container B being connected with the screw cap 2. This process is supported by the material taper 50 of the supply container bottom 32, which acts comparable to a hinge. With it, the obliquely extending surface portion 48 effects the supply container bottom portion 32*a* by folding it downwards to a greater extent and faster, respectively. Thereby, a nearly complete opening and an improved emptying of the supply container 4 are obtained. Furthermore, the emptying can be supported by, as set forth above, the provided oblique extension of the supply container bottom portion 32*a*. With it, the emptying can be affected by means of the slope and inclination, respectively, of the supply container bottom portion 32*a*, for example, dependent on the type and shape of substances being arranged in the supply container 4.

In order to support the opening of the supply container 4 and in particular to enhance the folding away of the supply container bottom 32 or at least parts thereof, the supply container bottom 32 can be provided, at least partially, with a biasing force. The biasing force provides that, upon separation of the transition 52 and/or its completion, the supply container bottom 32 or at least portions thereof, such as for example the supply container bottom portion 32*a*, actively folds downward. Such a biasing force can be used for support of the hinge effect of the transition 50, or can effect without the transition 50 or independently from the transition 50, an opening of the supply container 4.

Upon further unscrewing the screw cap 2, the screw cap 2 moves relative to the supply container 4 until the step 20 of the inner cylinder 18 contacts the upper stop 62 of the supply container 4. The engagement between the stops 20 and 62 provides that the supply container 4 with the screw cap 2 is moved away from the container B.

In order to utilize the action of the transition 50 as a hinge, when separating the supply container 4 by means of the cutting edge 22, the supply container 4 is interlocked for rotation on the container B lengthwise, starting from an end of the transition 50 to the other end of the transition 50, and the transition 52 is separated. As illustrated in the middle upper illustration of FIG. 3, for the illustrated arrangement of the transition 50 according to the upper doted line, the transition 52 is separated starting from position I to position II. For the arrangement of the transition 50 illustrated by means of the lower doted line, the transition 52 is separated starting from position I to position III, while, for the transition 50 illustrated as vertically extending, the transition 52 is separated starting from position I to position IV.

In another embodiment of the invention, instead of folding downwards the supply container bottom 32 or at least portions thereof for opening of the supply container 4, for example by using the transition 50 and/or at least a partial biasing force, the cutting edge 22 and/or the transition 52 can be shaped such that, upon separation of the supply container bottom 32, an opening is produced, which is sufficient to empty substances G contained in the supply container 4. For that purpose, the cutting edge 22 can be dimensioned such that its separation of the supply container bottom 32 creates a sufficiently large opening. For example, the cutting edge 22 can be wedge-shaped and/or thicker than the inner cylinder 18. Alternatively or additionally, it is also possible to form the transition 52 wider than illustrated in the figures and/or to design it such that, upon separation by means of the cutting edge 22, a sufficiently large opening in the supply container 4 is generated, for example, such that wider portions of the transition 52 "brake away" rather than being separated by the cutting edge 22.

Since the cutting edge 22 cannot separate the face 44 of the pocket 36, the supply container bottom 32 remains connected with the supply container wall 30 via the transition 50 and the inner boundary surface 40, the face 44 and the outer boundary surface 42 of the pocket 36. This is the case independent of how far the screw cap 2 is rotated in the opening direction, before the engagement between the saw-tooth-like structures 58 and 72 is terminated and the supply container 4 together with the screw cap 2 is moved away from the container B. Thus, the supply container bottom 32 remains connected with the supply container wall 30, irrespective of how far the cutting edge 22 opens the supply container 4, and it cannot fall into the container B. To what extent the cutting edge 22 separates the transition 52 depends upon, among other things, which substances the supply container 4 is provided with and/or which ratio these substances are to be supplied to the container B.

By means of further unscrewing, the screw cap 2, and the supply container 4 further being connected therewith, can be removed from the container and, if applicable, can be screwed onto the same again, in order to close the same.

What is claimed is:

1. A twist closure means for a container, comprising:

a screw cap comprising an inner cylinder and a cutting edge extending from the inner cylinder in a longitudinal direction thereof; and a supply container rotatably arrangeable on the inner cylinder, the supply container comprising a supply container bottom and a pocket extending from the supply container bottom in a longitudinal direction thereof for accommodation of the cutting edge, wherein the pocket is configured to accommodate the cutting edge when the supply container is maximally pushed onto the inner cylinder.

2. The twist closure means according to claim 1, wherein the pocket comprises an even lower face and a curved face extending therefrom towards the supply container bottom.

3. The twist closure means according to claim 2, further comprising:

a transition from the curved face to an outer surface of the pocket, the transition comprising a material taper.

4. The twist closure means according to claim 1, wherein the supply container further comprises a cylindrically shaped supply container wall for partially enclosing the inner cylinder, the twist closure means further comprising:

a transition between the supply container bottom and the supply container wall, the transition comprising a material taper.

5. The twist closure means according to claim 4, wherein the transition between the supply container bottom and the supply container wall is helically shaped with a pitch which corresponds with a pitch of a thread pairing provided for arrangement of the screw cap on the container.

6. The twist closure means according to claim 1, wherein the supply container further comprises, on its end opposite the supply container bottom, a collar having a saw-tooth-like structure.

7. The twist closure means according to claim 6, wherein the collar is arranged on the outer side of the supply container, and the saw-tooth-like structure points toward the supply container bottom.

8. The twist closure means according to claim 6, wherein the saw-tooth-like structure is a rotation interlock for the supply container upon opening of the twist closure means for a predetermined rotation of the screw cap in an opening direction.

9. The twist closure means according to claim 7, wherein the saw-tooth-like structure is a rotation interlock for the supply container upon opening of the twist closure means for a predetermined rotation of the screw cap in an opening direction.

10. The twist closure means according to claim 1, wherein the inner cylinder includes a step extending in the peripheral direction on its outer peripheral surface.

11. The twist closure means according to claim 6, wherein the inner cylinder includes a step extending in the peripheral direction on its outer peripheral surface.

12. The twist closure means according to claim 10, wherein the supply container further comprises an inner side of the supply container including an upper stop and a lower stop for interaction with the step.

13. The twist closure means according to claim 12, wherein the upper stop and the lower stop on the inner side of the supply container are formed in a ring shape.

14. The twist closure means according to claim 1, wherein the screw cap further comprises an inner side of the screw cap, the twist closure means further comprising:

a stop for the supply container formed on the inner side of the screw cap, adjacent to the end of the inner cylinder opposite the cutting edge.

15. The twist closure means according to claim 14, wherein the stop for the supply container comprises a bar circularly surrounding the inner cylinder.

16. The twist closure means according to claim 1, wherein the screw cap further comprises a screw cap wall surrounding the inner cylinder, the twist closure means further comprising:

a thread arranged on the inner side of the screw cap wall.

17. The twist closure means according to claim 16, wherein the screw cap further comprises a screw cap ceiling which is connected to the screw cap wall, the twist closure means further comprising:

an originality ring attached on the screw cap wall opposite the screw cap ceiling, the originality ring comprising a connection formed as a predetermined breaking point.

* * * * *